US009402431B1

(12) United States Patent
Orsburne

(10) Patent No.: US 9,402,431 B1
(45) Date of Patent: Aug. 2, 2016

(54) CLOTHING ADJUSTMENT DEVICE

(71) Applicant: Troy Nelson Orsburne, Winslow, AR (US)

(72) Inventor: Troy Nelson Orsburne, Winslow, AR (US)

( * ) Notice: Subject to any disclaimer, the term of this patent is extended or adjusted under 35 U.S.C. 154(b) by 272 days.

(21) Appl. No.: 14/152,525

(22) Filed: Jan. 10, 2014

(51) Int. Cl.
*B65H 75/28* (2006.01)
*A41F 1/00* (2006.01)

(52) U.S. Cl.
CPC ..... *A41F 1/00* (2013.01)

(58) Field of Classification Search
CPC ..... B65H 75/28; B65H 75/406
USPC ..... 242/378, 378.1–378.3, 388, 242/388.1–388.3
See application file for complete search history.

(56) References Cited

U.S. PATENT DOCUMENTS

| | | | | |
|---|---|---|---|---|
| 169,770 | A | 11/1875 | Burnham | |
| 567,367 | A | 9/1896 | Truelsen | |
| 799,767 | A * | 9/1905 | Weisenborn | B60P 7/083 24/909 |
| 1,467,420 | A * | 9/1923 | Breer | D06F 53/04 24/909 |
| 1,606,221 | A | 11/1926 | Hergesheimer | |
| 3,430,303 | A | 3/1969 | Perrin et al. | |
| 3,559,852 | A | 2/1971 | Green | |
| 3,954,226 | A | 5/1976 | Pickering | |
| 4,604,773 | A | 8/1986 | Weber et al. | |
| 4,612,686 | A | 9/1986 | Bowers | |
| 5,566,397 | A | 10/1996 | Scott | |
| 5,695,147 | A | 12/1997 | Zimmerman | |
| 6,241,174 | B1 | 6/2001 | Nelsen et al. | |
| 6,431,487 | B1 | 8/2002 | Wall | |
| 6,434,754 | B2 | 8/2002 | Kato | |
| 7,086,126 | B2 | 8/2006 | English | |
| 7,150,425 | B2 | 12/2006 | Banaszkiewicz et al. | |
| 7,155,784 | B1 | 1/2007 | DeGroot | |
| 7,252,259 | B2 | 8/2007 | Kovacevich et al. | |
| 8,327,510 | B2 | 12/2012 | Schlesinger | |
| 2003/0168545 | A1 * | 9/2003 | Yu | H02G 11/02 242/388.1 |
| 2006/0162191 | A1 | 7/2006 | Mason | |
| 2013/0001352 | A1 | 1/2013 | Balsells et al. | |

FOREIGN PATENT DOCUMENTS

| | | |
|---|---|---|
| EP | 0599484 | 6/1994 |
| EP | 1922943 | 5/2008 |
| EP | 2386327 | 11/2011 |

* cited by examiner

*Primary Examiner* — Sang Kim
(74) *Attorney, Agent, or Firm* — Schrantz Law Firm, PLLC; Stephen D. Schrantz

(57) ABSTRACT

The clothing adjustment device enables the adjustment of an article of clothing. In one embodiment, the clothing adjustment device is placed upon a user's clothing, such as pants, shorts, skirts, or other clothing at waist level. The clothing adjustment device provides an adjustment head, an inner body, and an outer body. Both the inner body and the outer body provide a pair of fingers with an insertion aperture. The user inserts the section of the article of clothing to be cinched within the insertion aperture between the pair of fingers of the inner body and the outer body. The inner body then rotates in relation to the outer body to cause at least a portion of the article of clothing to be wound upon the inner body. The adjustment head and inner body are secured with a geared system that prevents the adjustment head from rotating allowing the clothing to unwind from the inner body.

12 Claims, 26 Drawing Sheets

CLOTHING ADJUSTMENT DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates generally to a device that is used to assist a user with maintaining the position of the user's pants. The present invention maintains the position by taking up slack, cinching, or shortening, a portion of an article of clothing. More specifically, the present invention relates to a device suitable for taking up slack, shortening, cinching, or temporarily hemming an article of clothing, such as pants, shirts, shorts, skirts, etc. The device is particularly suitable for the removal of slack from the waist.

In the known art, belts and suspenders are commonly used to maintain the position of a user's pants. Belts provide a secondary support around a user's waist. The belt may be used for both support purposes and decorative purposes. Suspenders, on the other hand, support the user's pants by being worn over the user's shoulders. Similar to belts, suspenders may be used for both support and decorative purposes.

Belts and suspenders suffer from many disadvantages which makes them undesirable to use. For example, both belts and suspenders require a user to be sized for the use of a belt or suspenders. The belt will be sized according to the user's waist size. Therefore, the user will need to purchase new belts as the user's size changes. For example, if the user's waist size increases, the user will need a longer belt. If the user's waist size decreases, the user will need a shorter belt.

The pre-punched belt holes also provide a disadvantage of the belts. The belts are pre-punched providing a limited number of sizes. If the user does not fit one of the pre-punched holes, the user will be required to use either a larger or smaller size due to the pre-punched holes. The user can punch a customized hole but could potentially destroy the look and integrity of the belt. Therefore, the user cannot customize the fit to the exact specifications needed by the user without destroying the look and integrity of the belt.

Because belts may also be used for decorative purposes, belts are available in many different colors and designs. Belts may or may not be fashionably acceptable for all clothes.

Therefore, a user may be required to purchase multiple belts so that the user can use different belts dependent upon the user's outfit.

Suspenders also provide disadvantages. Suspenders will be sized according to the size of the user. While suspenders allow adjustments, the suspenders will need to be sized according to child, adult, and big and tall. Therefore, different suspenders will be required depending upon the size of the user.

Similar to belts, suspenders may also be used for decorative purposes. Suspenders are available in many different colors and designs. Suspenders may or may not be fashionably acceptable for all clothes. Therefore, a user may be required to purchase multiple suspenders so that the user can use different suspenders depending upon the user's outfit.

The clothing adjustment device of the present invention overcomes many disadvantages of belts and suspenders. The clothing adjustment device provides beneficial features not found in currently available devices. In view of the foregoing, the clothing adjustment device of the present invention is well suited for adjusting the fit of an article of clothing. The adjustment device of the present invention provides a device that universally fits different sized users. Therefore, the present invention is needed to provide a more cost effective device to adjust a user's clothing.

2. Description of the Known Art

Patents and patent applications disclosing relevant information are disclosed below. These patents and patent applications are hereby expressly incorporated by reference in their entirety.

U.S. Pat. No. 8,327,510 issued to Schlesinger on Dec. 11, 2012 (the '510 patent) teaches a device and method for temporary hemming/cuffing children's pants legs. A base member and a securement member taught by the '510 patent sandwich material to be hemmed between one another. The base member and the securement member taught by the '510 patent are operatively engaged with one another by way of tab extending axially from the securement member, which are engageable with lip portions of the base member. When the securement member and the base member taught by the '510 patent sandwich the material to be hemmed, portions of the material, especially any seams, are positioned within spaces or passages defined by the tabs.

U.S. Pat. No. 7,252,259 issued to Kovacevich, et al. on Aug. 7, 2007 ("the '259 patent") teaches a method of drawing lines into a housing includes: rotating a dial in a first rotational direction of the dial such that a first spool located in an interior of the housing is mechanically rotated in a first rotational direction thereby winding a first line thereabout; and rotating the same dial in a second rotational direction opposite to the first rotational direction such that a second spool located in the interior of the housing is mechanically rotated in a first rotational direction thereby winding a second line thereabout. The '259 patent teaches that rotating of the same dial in the second, opposite rotational direction does not result in unwinding of the first line from the first spool, and the rotating of the same dial in the first rotational direction does not result in unwinding of the second line from the second spool.

U.S. Pat. No. 6,241,174 issued to Nelsen, et al. on Jun. 5, 2001 ("the '174 patent") teaches a belt shortening device intended for use with a vehicle seat belt securing a baby seat is constructed and arranged so that it can be easily mounted to the existing seat belt without detaching the belt from its existing connection. The belt shortening device taught by the '174 patent includes a tubular housing, a spindle rotatably received within the housing, and a ratchet mechanism operable for controlling rotation of the spindle. The housing taught by the '174 patent has an open end and a closed end and includes a pair of longitudinal slits extending inwardly from the open end. The '174 patent teaches that the slits are symmetrically arranged in opposed relation so as to define a transverse slot in the housing for receiving the belt therein. A ratchet pawl taught by the '174 patent is mounted in the side wall of the housing adjacent the open end thereof. The '174 patent teaches that the spindle has a body portion and two spaced arms extending perpendicularly outwardly from the body portion. The spaced arms taught by the '174 patent define a longitudinal slot for transversely receiving the belt therein. The peripheral edge of the body portion taught by the '174 patent includes a plurality of ratchet teeth. In use, the spindle taught by the '174 patent is received in assembled relation with the housing and the belt such that the belt is transversely received within the slits of said housing and between the arms of the spindle, and further such that the body portion of the spindle is seated within the open end of the housing with the ratchet teeth slidably engaged with the pawl. The '174 patent teaches that the spindle is rotatable relative to housing to wind the belt within the housing.

U.S. Pat. No. 5,695,147 issued to Zimmerman on Dec. 9, 1997 ("the '147 patent") teaches a length controller (20) and method of use for adjusting the effective length of a flexible line (23), wherein the flexible line (23) is fixed at both ends and is used for hanging objects such as pictures (62), mirrors, and the like from a wall or other supporting structure. The controller (20) taught by the '147 patent comprises a body (22) having first and second line engaging means. A rotor (24) taught by the '147 patent is rotatably connected to the body (22), and has a first line receiving slot (26). A ratcheting means taught by the '147 patent permits the rotor (24) to rotate in one direction only relative to the body (22). The flexible line (23) taught by the '147 patent is inserted into first and second line engaging means (28, 30) and the first line receiving slot (26). The '147 patent teaches that the rotor (24) is then turned to decrease the effective length of the flexible line (23). A ratchet disengaging means taught by the '147 patent releases the ratchet means and enables an increase in the effective length of the flexible line (23).

SUMMARY OF THE INVENTION

The clothing adjustment device of the present invention enables the adjustment of an article of clothing. In one embodiment, the clothing adjustment device is placed upon a user's pants, shorts, skirts, etc. at waist level. The clothing adjustment device provides an adjustment head, an inner body, and an outer body. Both the inner body and the outer body provide a pair of fingers with an insertion aperture. The user inserts the section of the article of clothing to be cinched within the insertion aperture between the pair of fingers of the inner body and the outer body. In one embodiment, the user inserts the waist line of an article of clothing such as a pair of pants, shorts, skirts, etc. between the pair of fingers.

The inner body then rotates in relation to the outer body to cause at least a portion of the article of clothing to be wound upon the inner body. The article of clothing is wound at least partially within the outer body. In one embodiment, the adjustment head rotates the inner body in relation to the outer body. The adjustment head attached to the inner body is secured with a geared system that limits rotation of the adjustment head from rotating limiting the clothing from unwinding from the inner body.

The clothing adjustment device of the present invention is intended for use with an article of clothing having a waist section, including but not limited to pants, shorts, skirts, etc. The clothing adjustment device is particularly constructed and arranged so that it can be easily placed on the article of clothing. More specifically, the clothing adjustment device includes a cylindrical or cylindrical like outer housing, an inner housing rotatably received within the outer housing, and a ratchet mechanism operable for controlling rotation of the inner housing and winding of the clothing around the inner housing.

The outer housing has an open end at the insertion aperture. Similarly, the inner housing has an open end at the insertion aperture. The inner housing may rotate in relation to the outer housing to enable the insertion aperture of the inner housing to be aligned with the insertion aperture of the outer housing. The alignment of the insertion aperture of the inner housing with the insertion aperture of the outer housing enables at least a portion of the article of clothing to be placed within the insertion apertures of the inner housing and the outer housing.

Locking teeth located within the outer housing reduce rotation of the inner housing within the outer housing. A locking finger of the inner housing contacts the locking teeth to limit the rotation of the inner housing. The locking teeth limit movement of the locking finger to reduce the clothing from unwinding from the inner housing.

The locking finger is secured to the inner housing and is positioned within the outer housing. The adjustment head attached to the inner housing is spring loaded within the outer housing to bias locking finger upward into the outer housing. Therefore, the locking finger is biased into an aperture between the locking teeth. When assembled, the inner housing is rotatable relative to the outer housing to wind at least a portion of the clothing around the inner housing within the outer housing. The locking teeth hold the locking finger in place to reduce unwinding of the clothing.

To unwind the article of clothing, pressure is applied to the adjustment head to overcome the bias of the spring. Overcoming the bias of the spring transfers the locking finger outside of the locking teeth and allows rotation of the inner housing in relation to the outer housing. Such rotation allows the clothing to unwind from the inner housing.

Accordingly, it is an object of the present invention to provide a device that enables adjustment of an article of clothing.

It is another object of the present invention to provide a compact device that may be discretely applied to a user's clothing.

It is another object of the present invention to provide a universal device that is not dependent upon the size of the user.

It is another object of the present invention to provide a device that may be shared between users.

It is another object of the present invention to provide a compact device that may easily travel.

It is another object of the present invention to reduce the number of items a user may need to maintain a user's clothing, such as pants, shorts, skirts, etc. at a desirable position.

It is another object of the present invention to provide a device that can be easily fitted to a user's clothing.

These and other objects and advantages of the present invention, along with features of novelty appurtenant thereto, will appear or become apparent in the course of the following descriptive sections and the attached drawings.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
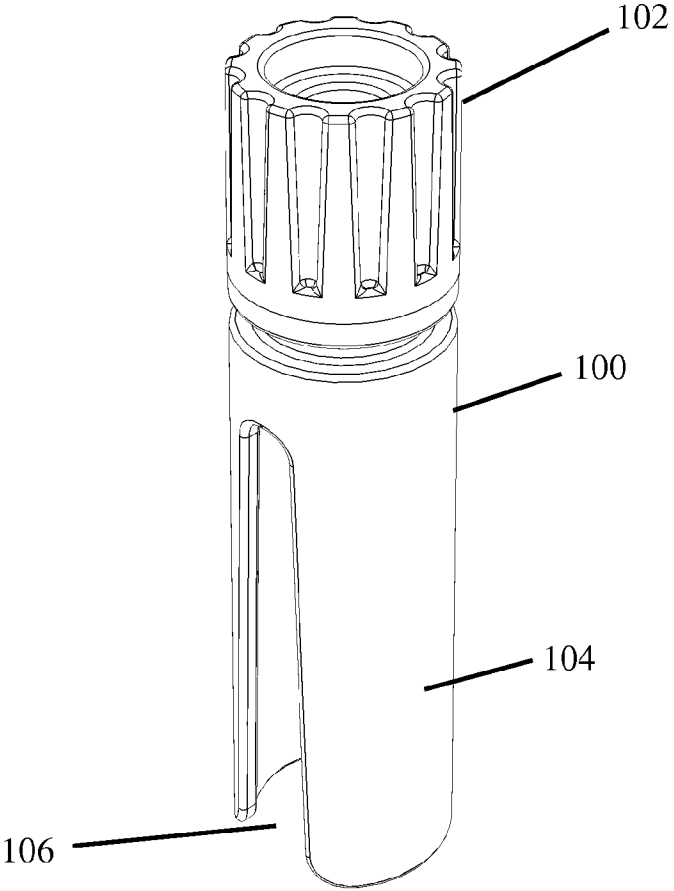
FIG. 1 is a perspective view showing one embodiment of the present invention.

The clothing adjustment device 100 of the present invention enables the adjustment of an article of clothing. In one embodiment, the clothing adjustment device 100 is placed upon a user's clothing, such as pants, shorts, skirts, or other clothing at waist level. The clothing adjustment device 100 provides an adjustment head 102, an inner body 108, and an outer body 104. Both the inner body 108 and the outer body 104 provide a pair of fingers with an insertion aperture. The user inserts the section of the article of clothing to be cinched within the insertion apertures 106, 110 between the pair of fingers 116, 118 of outer body 104 and fingers 130, 132 of the inner body 108. In one embodiment, the user inserts the clothing, such as the waist line of a pair of pants, shorts, skirts, etc. between the pair of fingers 116, 118, 130, 132. In one embodiment, the insertion apertures 106, 110 form a bottom entry 107 located at the bottom of the adjustment device 100.

The inner body 108 rotates in relation to the outer body 104 to cause at least a portion of the article of clothing to be wound upon the inner body 108. The article of clothing is wound at least partially within the outer body 104. In one embodiment, the adjustment head 102 rotates the inner body 108 in relation to the outer body 104. The adjustment head 102 attached to inner body 108 is secured with a geared system that limits the rotation of the adjustment head 102 to limit the clothing from unwinding from the inner body 108.

The clothing adjustment device 100 of the present invention is intended for use with an article of clothing having a waist section, including but not limited to pants, shorts, skirts, etc. The clothing adjustment device 100 is particularly constructed and arranged so that it can be easily placed on the article of clothing. More specifically, the clothing adjustment device 100 includes a cylindrical or cylindrical like outer body 104, an inner body 108 rotatably received within the outer body 104, and a ratchet mechanism operable for controlling rotation of the inner body 108 and winding of the clothing around the inner body 108.

The outer body 104 has an open end at the insertion aperture 106. Similarly, the inner body 108 has an open end at the insertion aperture 110. The inner body 108 may rotate in relation to the outer body 104 to align the insertion aperture 110 of the inner body 108 with the insertion aperture 106 of the outer body 104. The alignment of the insertion aperture 110 of the inner body 108 with the insertion aperture 106 of the outer body 104 enables at least a portion of the article of clothing to be placed within the insertion apertures 106, 110 of the inner body 108 and the outer body 104.

Locking teeth 122 located within the outer housing 104 reduce rotation of the inner housing 108 within the outer housing 104. A locking finger 126 of the inner housing 108 contacts the locking teeth 122. The locking teeth 122 limit movement of the locking finger 126 to reduce the clothing from unwinding from the inner housing 108.

The locking finger 126 is secured to the inner housing 108 and is positioned within the outer housing 104. The adjustment head 102 attached to the inner housing 108 is spring loaded within the outer housing 104 to bias locking finger 126 upward into the outer housing 104. Therefore, the locking finger 126 is biased into an aperture between the locking teeth 122. When assembled, the inner housing 108 is rotatable relative to the outer housing 104 to wind at least a portion of the clothing around the inner housing 104 within the outer housing 108. The locking teeth 122 hold the locking finger 126 in place to reduce rotation of the inner body 108 and to reduce unwinding of the clothing.

To unwind the article of clothing, pressure is applied to the adjustment head 102 to overcome the bias of the spring 138. Overcoming the bias of the spring 138 transfers the locking finger 126 outside of the locking teeth 122 and allows rotation of the inner housing 108 in relation to the outer housing 104. Such rotation allows the clothing to unwind from the inner housing 108.

FIG. 1 shows an environmental view of adjustment device 100. The adjustment device 100 may be constructed from plastic, metal, and/or carbon fiber. The adjustment head 102 attaches to inner body 108 to secure the inner body 108 within the outer body 104. The inner body 108 and adjustment head 102 rotate in relation to the outer body 104.

Figure 2:
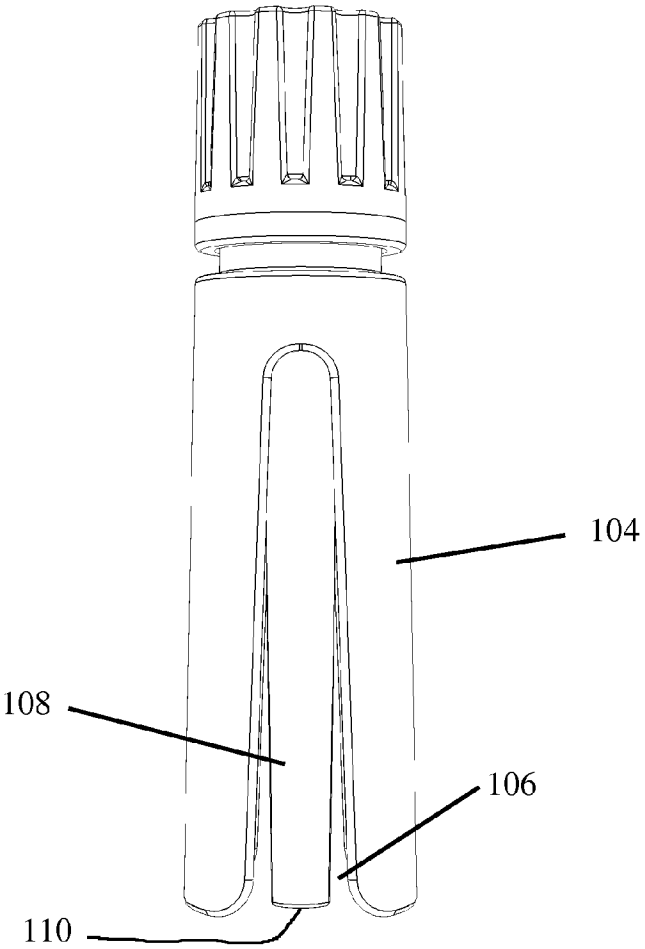
FIG. 2 is a front view thereof, the rear view being a mirror image of the front view.

As shown in FIG. 2, outer body 104 provides an insertion aperture 106. Insertion aperture 106 enables access to the inner body 108. Inner body 108 also provides an insertion aperture 110. Inner body 108 is secured to outer body 104 to allow for inner body 108 to rotate in relation to outer body 104. The securement of inner body 108 with outer body 104 will be discussed below. When at least a portion of clothing is placed within insertion apertures 106, 110, the attachment head 102 may be rotated which will cause inner body 108 to rotate in relation to outer body 104. The rotation of inner body 108 draws at least a portion of the article of clothing into outer body 104 while winding the clothing onto the inner body 108.

Figure 3:
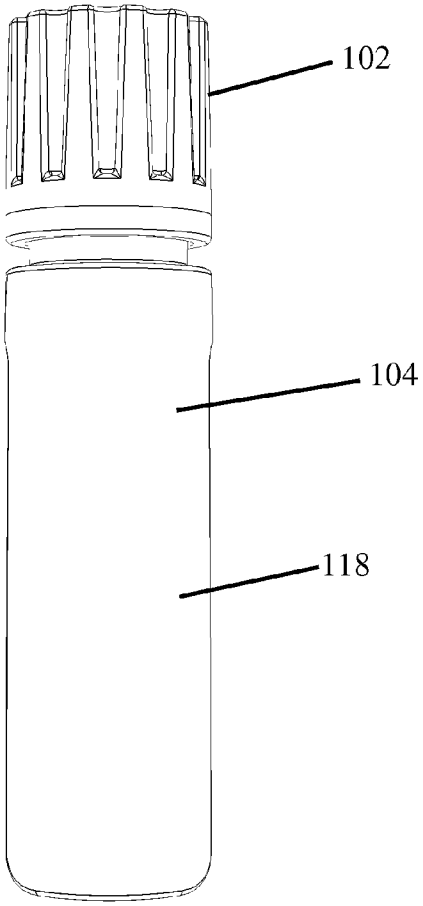
FIG. 3 is a right side view thereof, the left side being a mirror image of the right side view.

FIG. 3 shows at least one of the outer fingers 116, 118 of the outer body 104. The outer fingers 116, 118 partially enclose the article of clothing as the clothing is wound upon inner body 108. One embodiment of the present invention provides an outer finger 116, 118 that is smooth to provide a smooth contact with the user. Other embodiments may provide a padded section that will contact the user.

Figure 4:
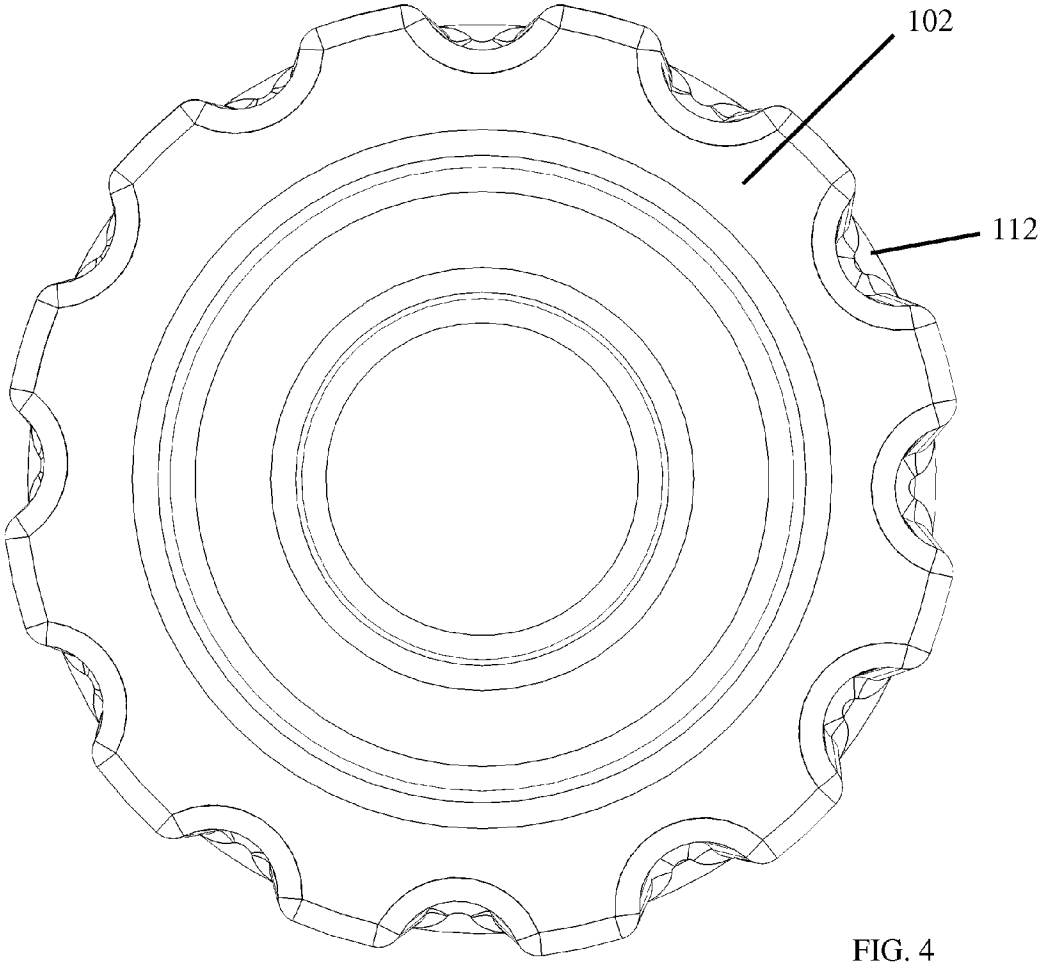
FIG. 4 is a top view thereof.

FIG. 4 shows a top view of the adjustment head 102. The adjustment head 102 rotates in relation to the outer body 104. The adjustment head 102 attaches to the inner body 108 to enable the adjustment head 102 to rotate with the inner body 108. Grips 112 of adjustment head 102 increase traction between a user and the adjustment head 102. The increased traction enables simpler rotation of the adjustment head 102.

Figure 5:
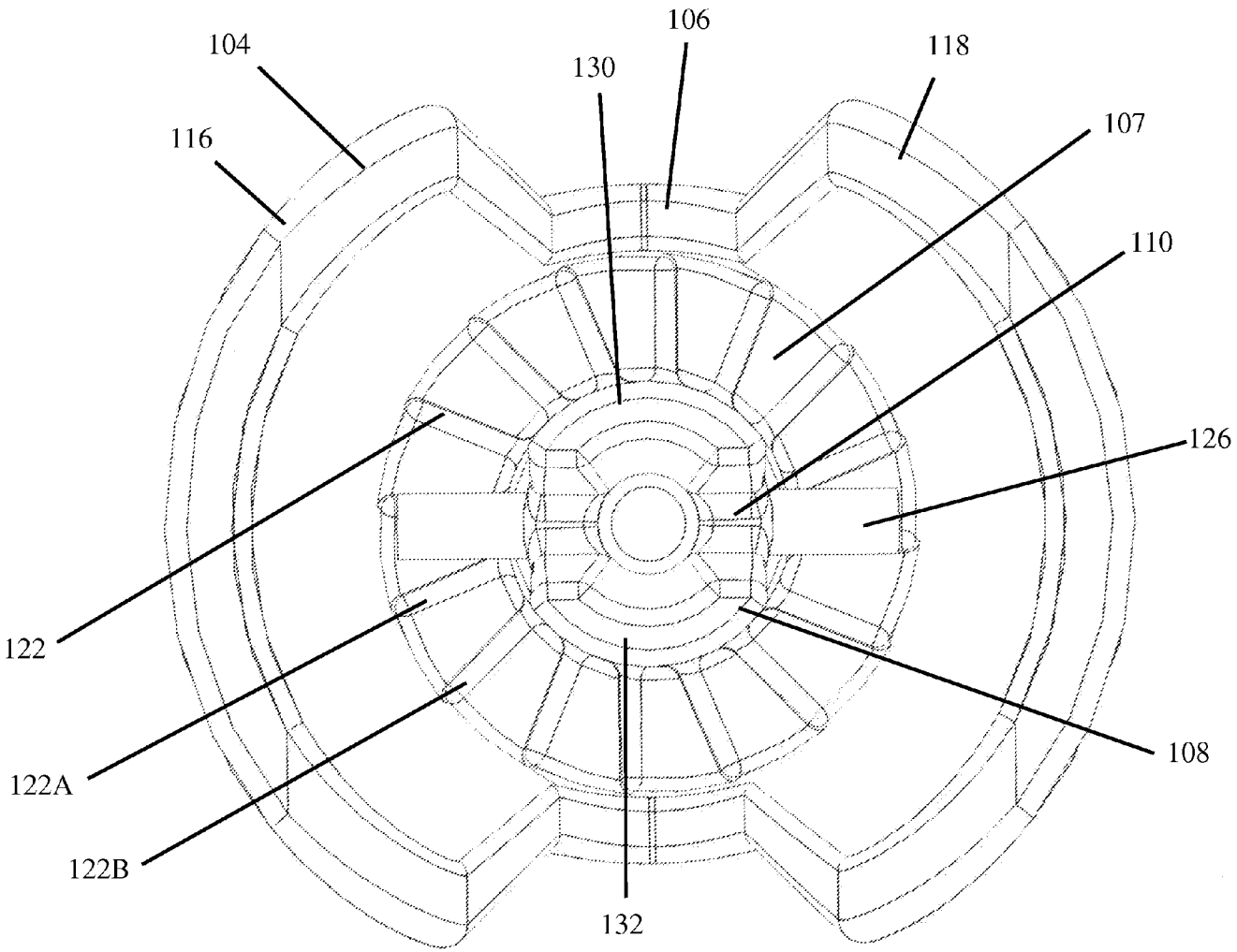
FIG. 5 is a bottom view thereof.
Figure 6:
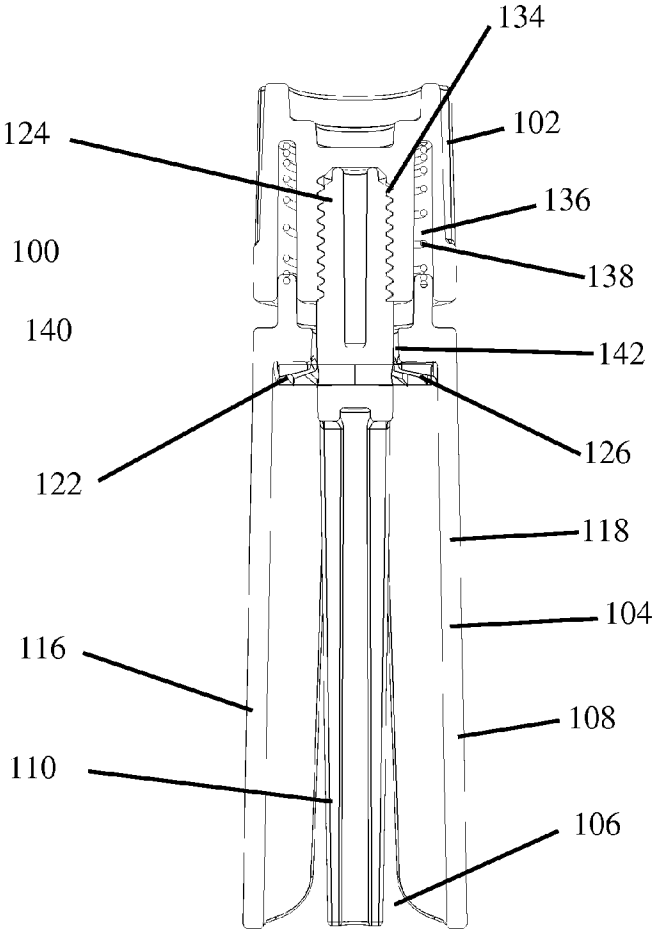
FIG. 6 is a sectional view thereof.

FIGS. 5 and 6 show the mechanics of the adjustment device 100. Outer body 104 partially encloses inner body 108. Outer body 104 provides insertion aperture 106 between outer fingers 116, 118. An article of clothing is placed within insertion aperture 106 between outer fingers 116, 118 and contact inner body 108. Inner body 108 provides insertion aperture 110 between inner fingers 130, 132. At least a portion of the article of clothing is placed between inner fingers 130, 132 to be wound around inner body 108 during rotation of the inner body 108. Winding the article of clothing around inner body 108 draws at least a portion of the clothing within outer body 104.

In one embodiment as shown in FIG. 6, the inner body 108 is rotatably secured with outer body 104. Inner body 108 is partially inserted into installation aperture 142 of outer body 104 and secured with the adjustment head 102. The attachment of the inner body 108 with the adjustment head 102 and locking finger 126 prevent the inner body 108 from passing completely through the outer body 104.

Threaded head 124 of inner body 108 fits through installation aperture 142 of outer body 104. Adjustment head 102 attaches to threaded head 124 as threaded head 124 at least partially passes through installation aperture 142. The adjustment head 102 prevents removal of inner body 108 from outer body 102 in one direction. Locking finger 126 prevents inner body 108 from completely passing through outer body 104. Contact between locking finger 126 and shoulder 140 on which locking teeth 122 are located prevents the inner body 108 from passing through outer body 102 in one direction.

The contact of locking finger 126 with shoulder 140 of one embodiment also limits rotation of the inner body 108 and adjustment head 102 in relation to outer body 104. Locking finger 126 and locking teeth 122, 122*a*, 122*b*, etc. limit the clothing from unwinding from the inner body 108. The locking teeth 122 provide inclines that limit movement of the locking finger 126. The locking teeth 122 of one embodiment provide inclines that do not allow rotation of the locking finger 126 in any direction. The locking teeth of another embodiment may provide ramped inclines that will allow rotation of the locking finger 126 in one direction (such as clockwise or counterclockwise rotation). In one embodiment, the present invention utilizes a ratcheting system.

Spring 138 biases locking finger 126 into the teeth 122 to limit rotation. To enable rotation in one embodiment providing ramped inclines, the user may rotate the adjustment head 102 in the direction of the ramped inclines to enable rotation.

To overcome the locking teeth 122, the adjustment head 102 may be depressed towards outer body 104 to counter spring 138. The adjustment head 102 depressed a sufficient distance to overcome the locking teeth 122 enables the adjustment head 102 to rotate freely of the locking teeth 122. To limit rotation, the user releases the adjustment head 102 to allow the spring 138 to bias the locking finger 126 into the locking teeth 122 again.

Figure 7:
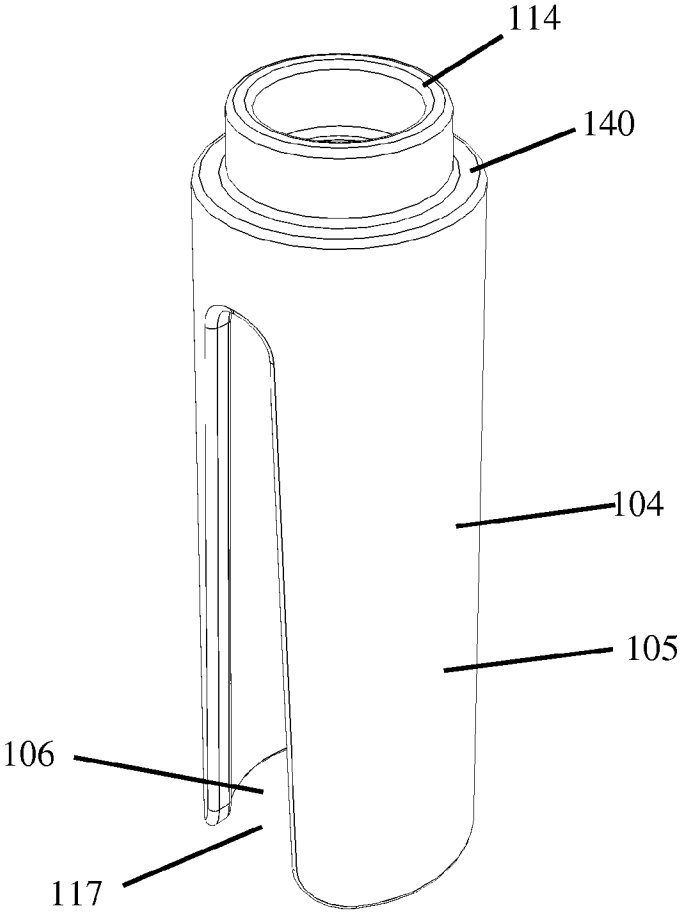
FIG. 7 is a perspective view of an outer housing of one embodiment of the present invention.
Figure 8:
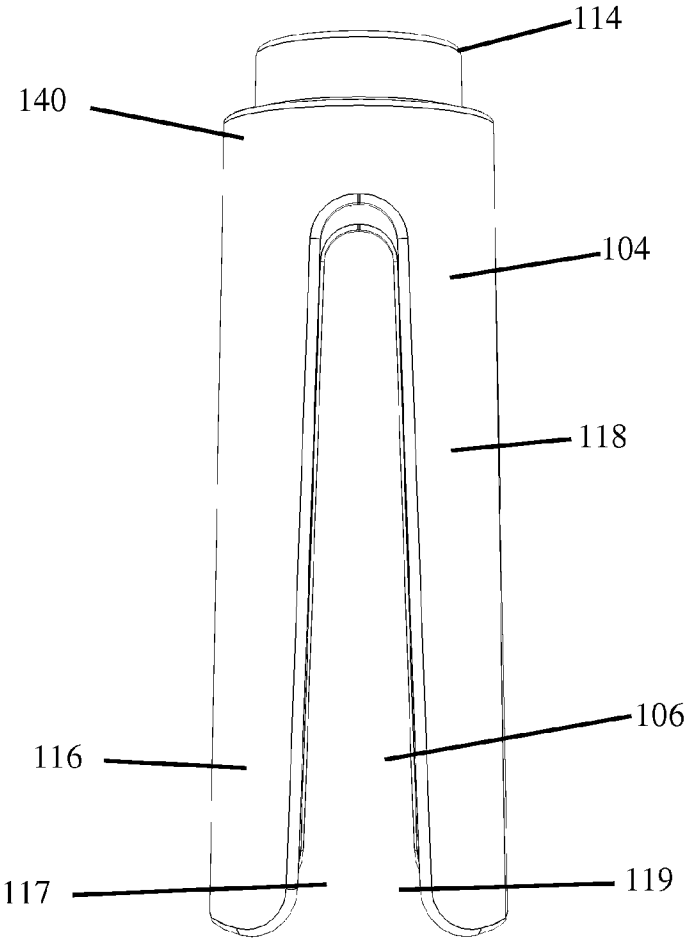
FIG. 8 is a front view thereof, the rear view being a mirror image of the front view.
Figure 9:
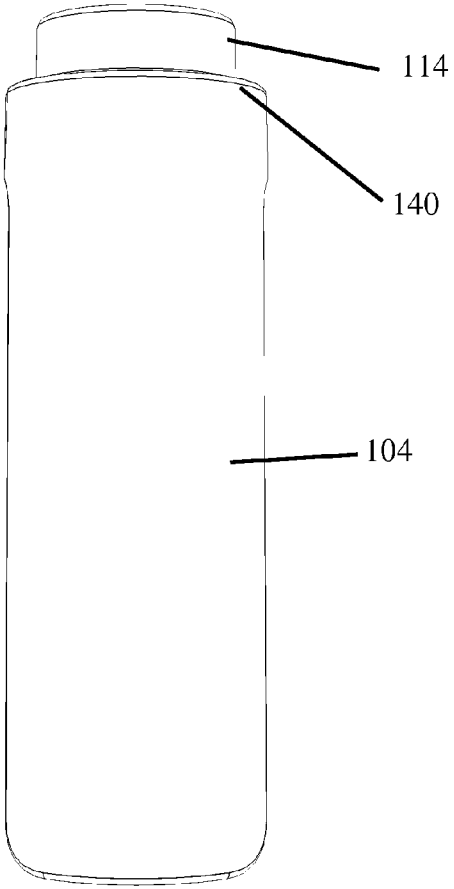
FIG. 9 is a right side view thereof, the left side view being a mirror image of the right side view.

FIGS. 7-9 show the outer body 104. Outer body 104 provides side wall 105 with outer fingers 116, 118 creating an insertion aperture 106 that allows a portion of an article of clothing to at least partially pass through the outer body 104. Openings 117, 119 of side wall 105 located between outer fingers 116, 118 allow passage of at least a portion of the clothing. The outer body 104 narrows from the shoulder 140 to installation aperture 142. The shoulder 140 and installation aperture 142 separate the outer body 104 into a first side and a second side. The narrowing of outer body 104 at installation aperture 142 prevents the locking finger 126 secured to inner body 108 from passing through installation aperture 142.

Neck 114 also helps maintain the positioning of adjustment head 102. As shown in FIG. 6, neck 114 provides a surface to support spring 138. Spring aperture 136 is sized to allow neck 114 to at least partially pass within spring aperture 136. Neck 114 is sized to allow rotation of the adjustment head 102 in relation to outer body 104. Neck 114 is also sized to allow adjustment head 102 to be depressed towards outer body 104 to counter spring 138. The movement of adjustment head 102 towards outer body 104 allows locking finger 126 to separate from locking teeth 122. After adequate separation of locking finger 126 from locking teeth 122, the inner body 108 may rotate freely within outer body 104.

Figure 10:
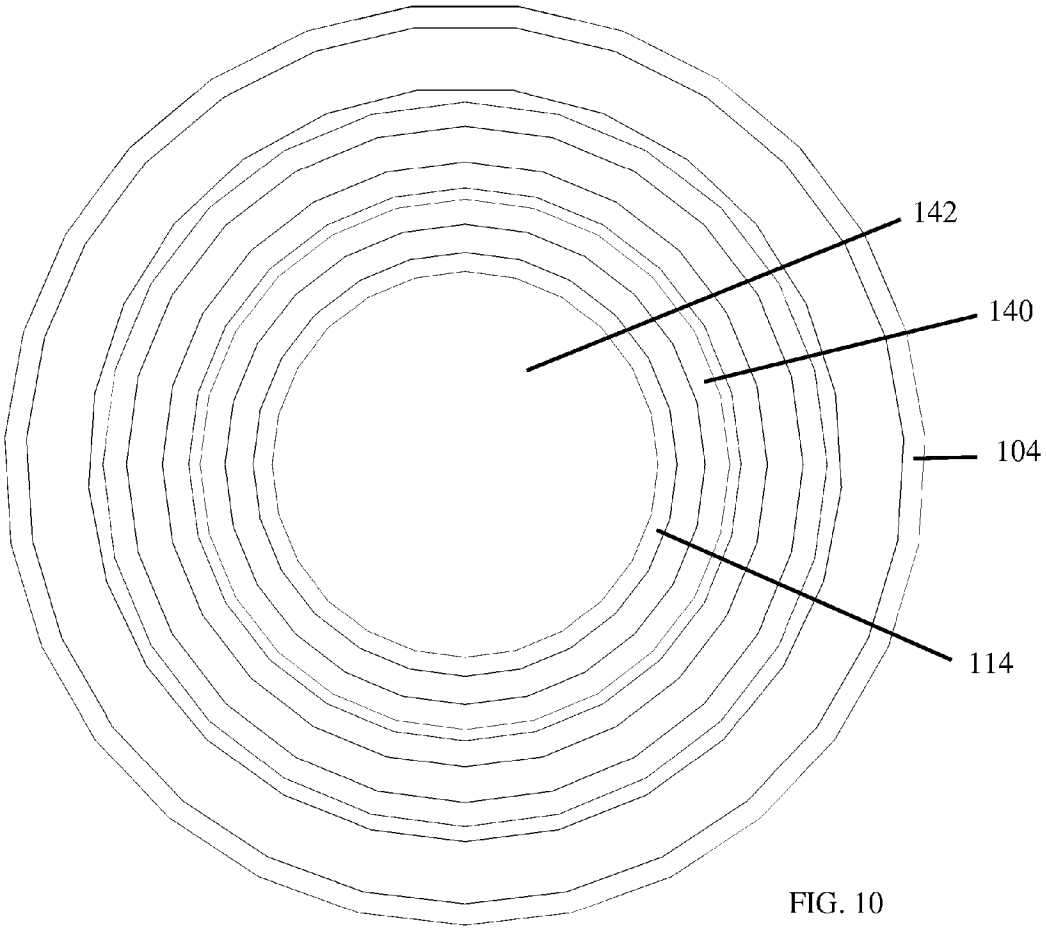
FIG. 10 is a top view thereof.

FIG. 10 shows the top view of the outer body 104. Installation aperture 142 is sized to allow threaded head 124 to pass through installation aperture 142. Installation aperture 142 also prevents the locking finger 126 attached to inner body 108 from passing through installation aperture 142. FIG. 10 also shows shoulder 114 and neck 140.

Figure 11:
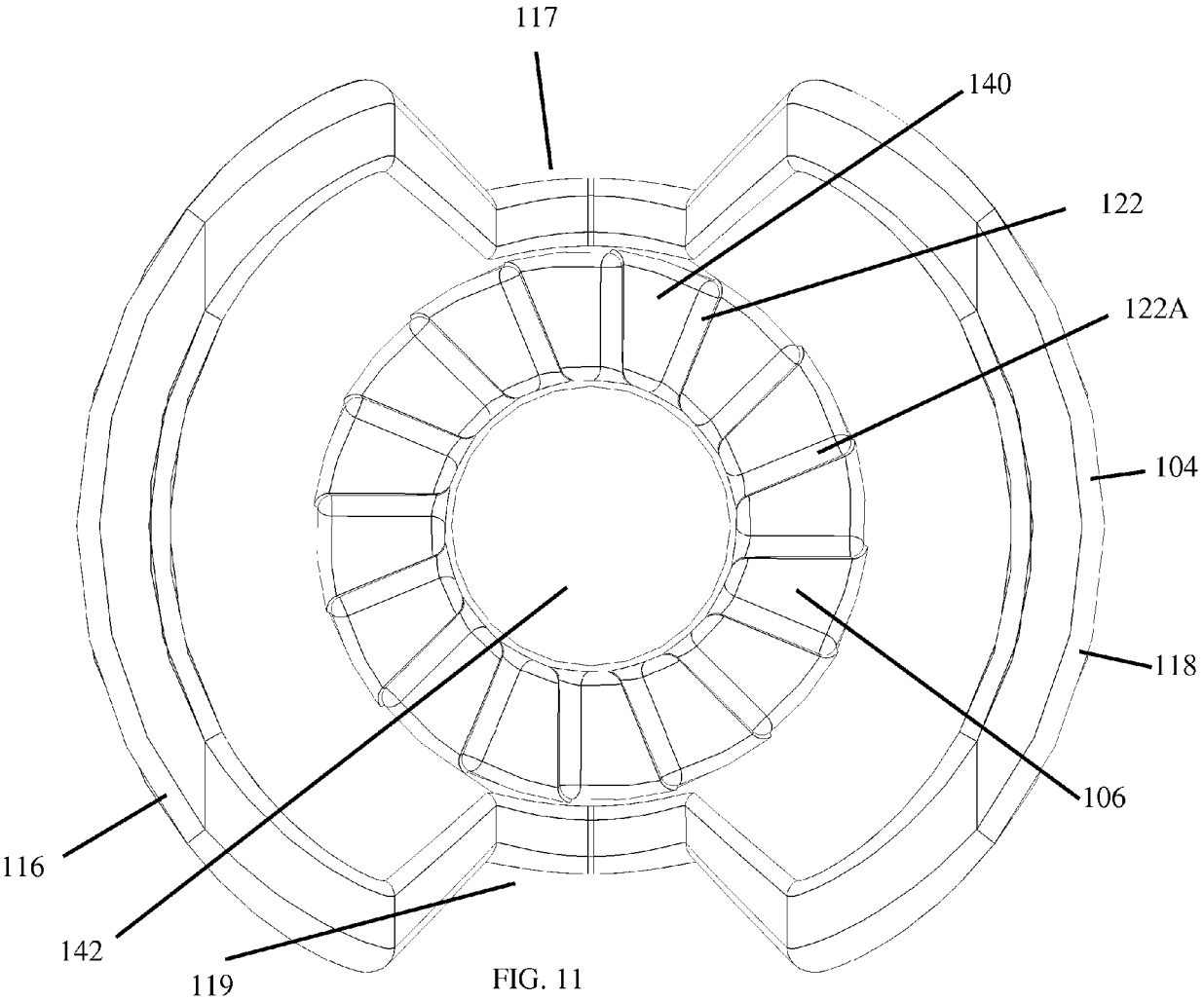
FIG. 11 is a bottom view thereof.
Figure 11B:
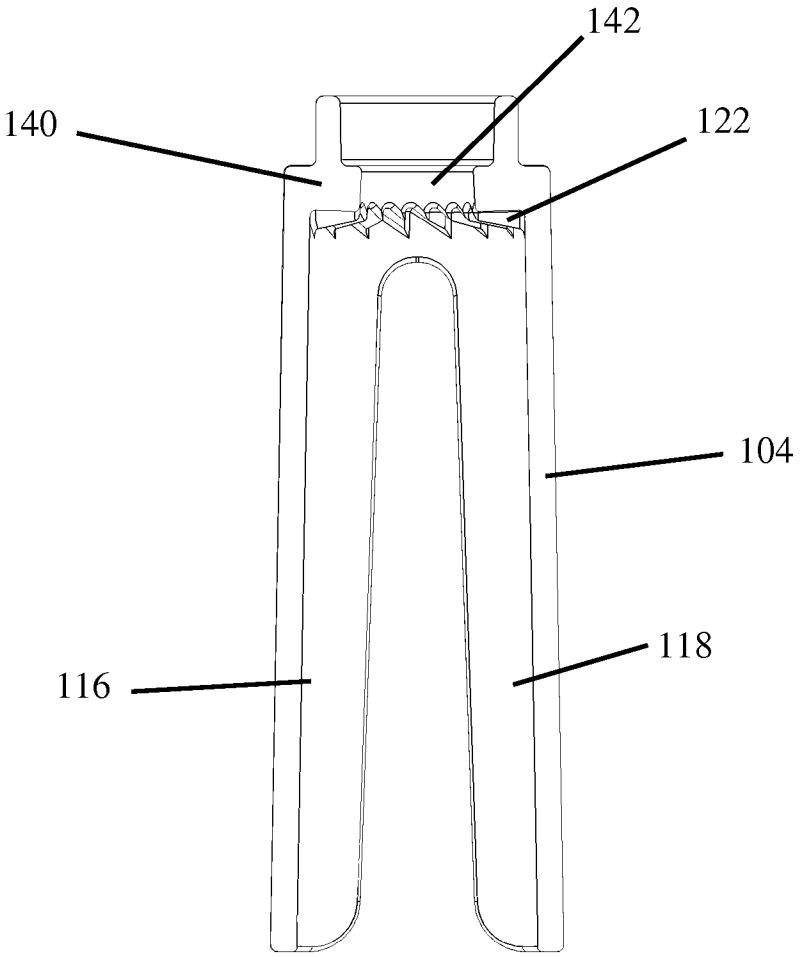
FIG. 11B is a sectional view thereof.
Figure 12A:
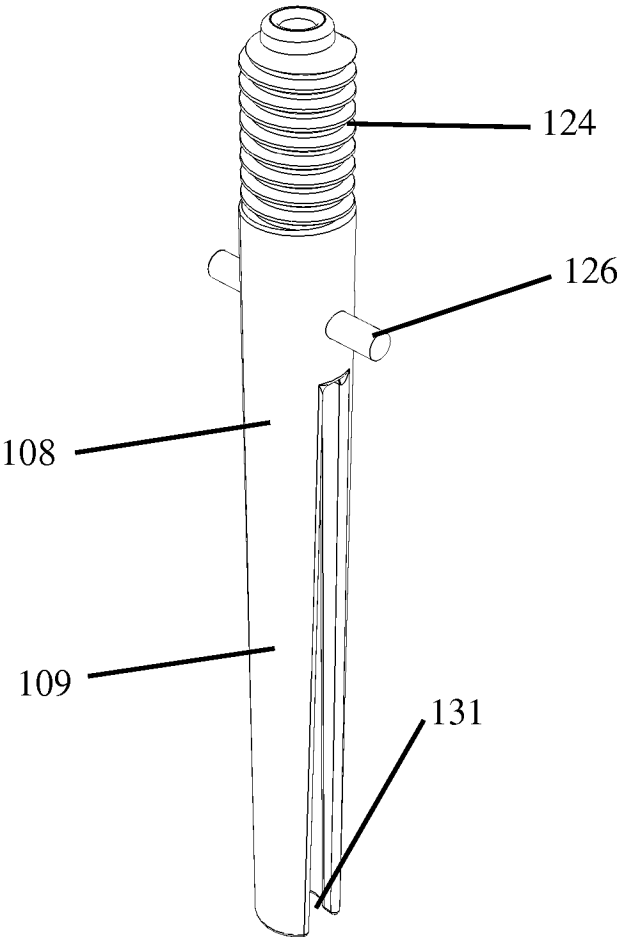
FIG. 12A is a perspective view of an inner housing of one embodiment of the present invention.
Figure 12B:
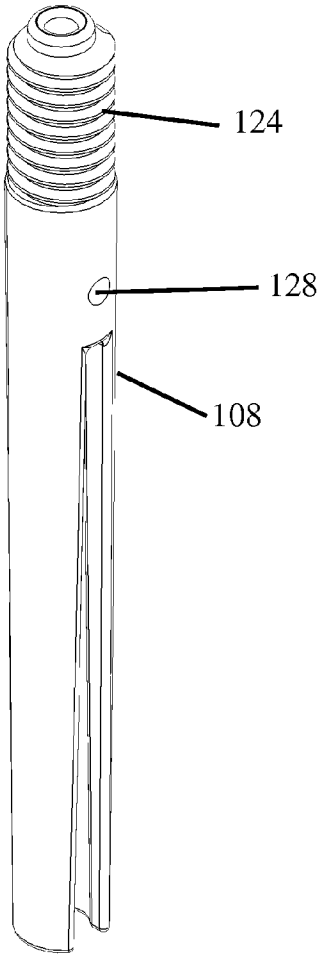
FIG. 12B is a perspective view of an inner housing of one embodiment of the present invention.
Figure 13A:
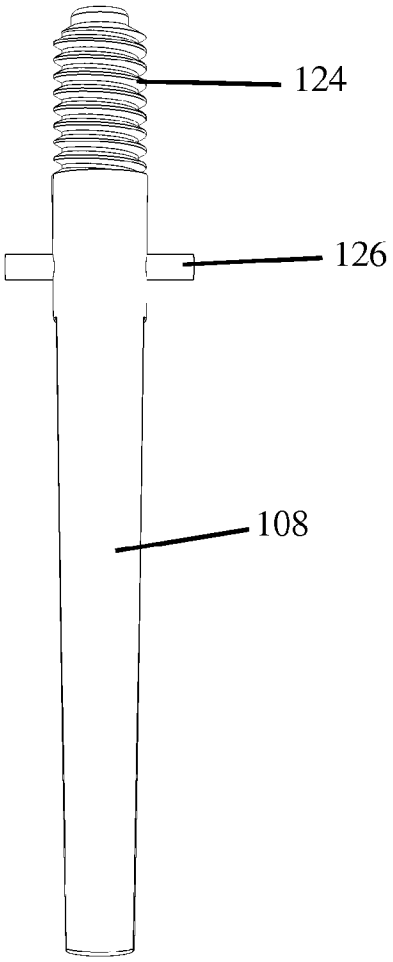
FIG. 13A is a front view of an inner housing of one embodiment of the present invention.
Figure 13B:
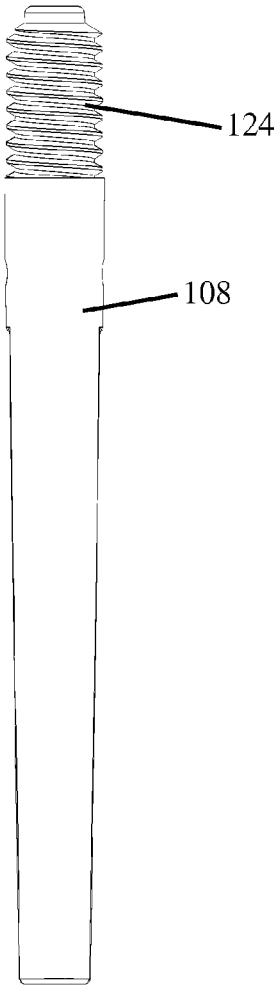
FIG. 13B is a front view of an inner housing of one embodiment of the present invention.
Figure 14:
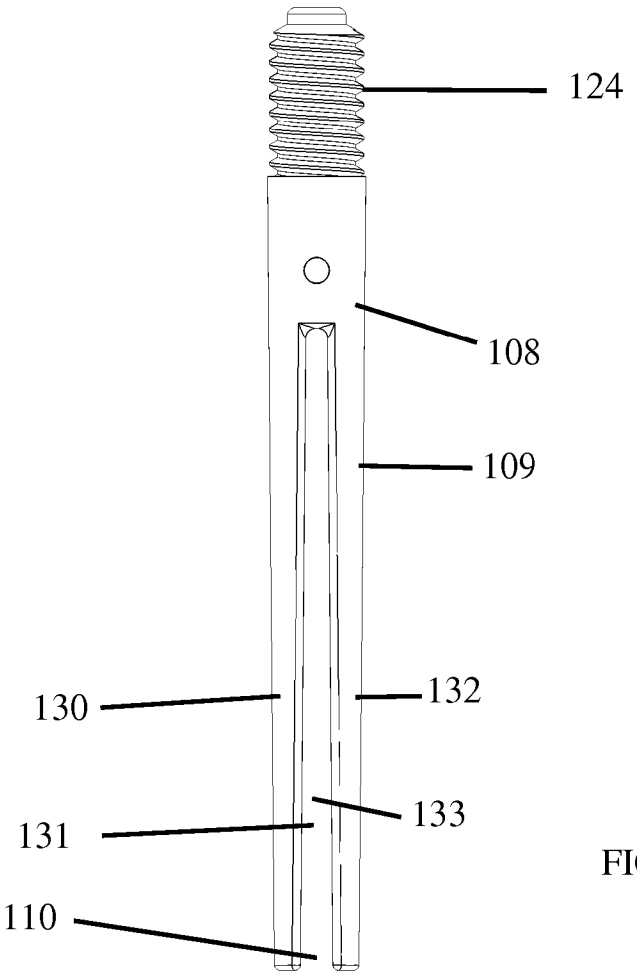
FIG. 14 is a right side view of an inner housing of one embodiment of the present invention, the left side view being a mirror image of the right side view.

FIG. 11 shows the bottom view of the outer body 104. Outer fingers 116, 118 create installation aperture 106 and openings 117, 119 for placement of at least a portion of the clothing. Locking teeth 122, 122*a* are located at shoulder 140. FIG. 11B shows the incline of one embodiment of teeth 122.

FIGS. 12-16 show the inner body 108 with locking finger 126 installed (See FIGS. 12*a*, 13*a*, 14*a*, 15*a*, 16*a*) and inner body 108 with locking finger 126 not installed (see FIGS. 12*b*, 13*b*, 14*b*, 15*b*, 16*b*). Inner body 108 provides side wall 109 with inner fingers 130, 132 creating an insertion aperture 110 that allows a portion of an article of clothing to pass through the inner body 108. Openings 131, 133 of side wall 109 located between inner fingers 130, 132 allow passage of at least a portion of the clothing.

Threaded head 124 enables attachment of adjustment head 102 to the inner body 108. As discussed earlier, threaded head 124 is sized to at least partially pass into installation aperture 142 of outer body 104.

Locking finger 126 is secured to the inner body 108. The locking finger 126 increases the size of inner body 108 to prevent inner body 108 from passing through installation aperture 142. The locking finger 126 also secures to inner body 108 to limit rotation of the inner body 108 and locking finger 126. The blocking of locking finger 126 by locking teeth 122 limits rotation of the locking finger 126 and inner body 108.

Finger installation aperture 128 provides an area for installing locking finger 126. Locking finger 126 is secured to inner body 108 such that locking finger 126 may limit rotation of the inner body 108 in relation to the outer body 104. The locking finger 126 also secures the inner body 108 at least partially within outer body 104.

Inner body 108 also provides inner fingers 130, 132. Inner fingers 130, 132 provide sufficient space at insertion aperture 110 for placement of at least a portion of the article of clothing. In one embodiment, the waist section of an article of clothing, including but not limited to a pair of pants, shorts, skirt, dress, etc. are placed into the insertion aperture 110 and openings 131, 133 between inner fingers 130, 132. Inner fingers 130, 132 are sized that inner fingers 130, 132 at least partially fit within insertion aperture 106 between outer fingers 116, 118.

Figure 15A:
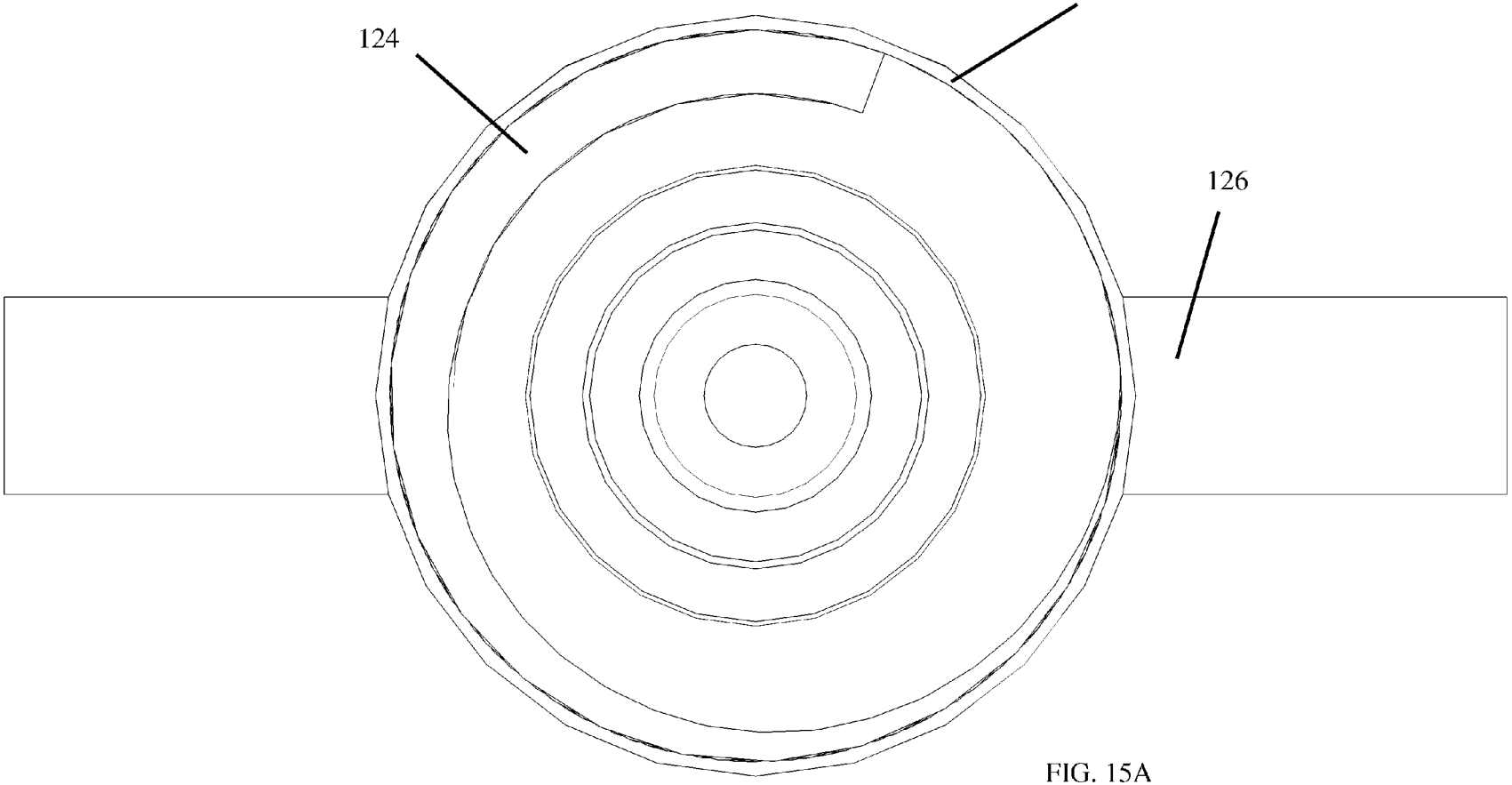
FIG. 15A is a top view of one embodiment of the present invention.
Figure 15B:
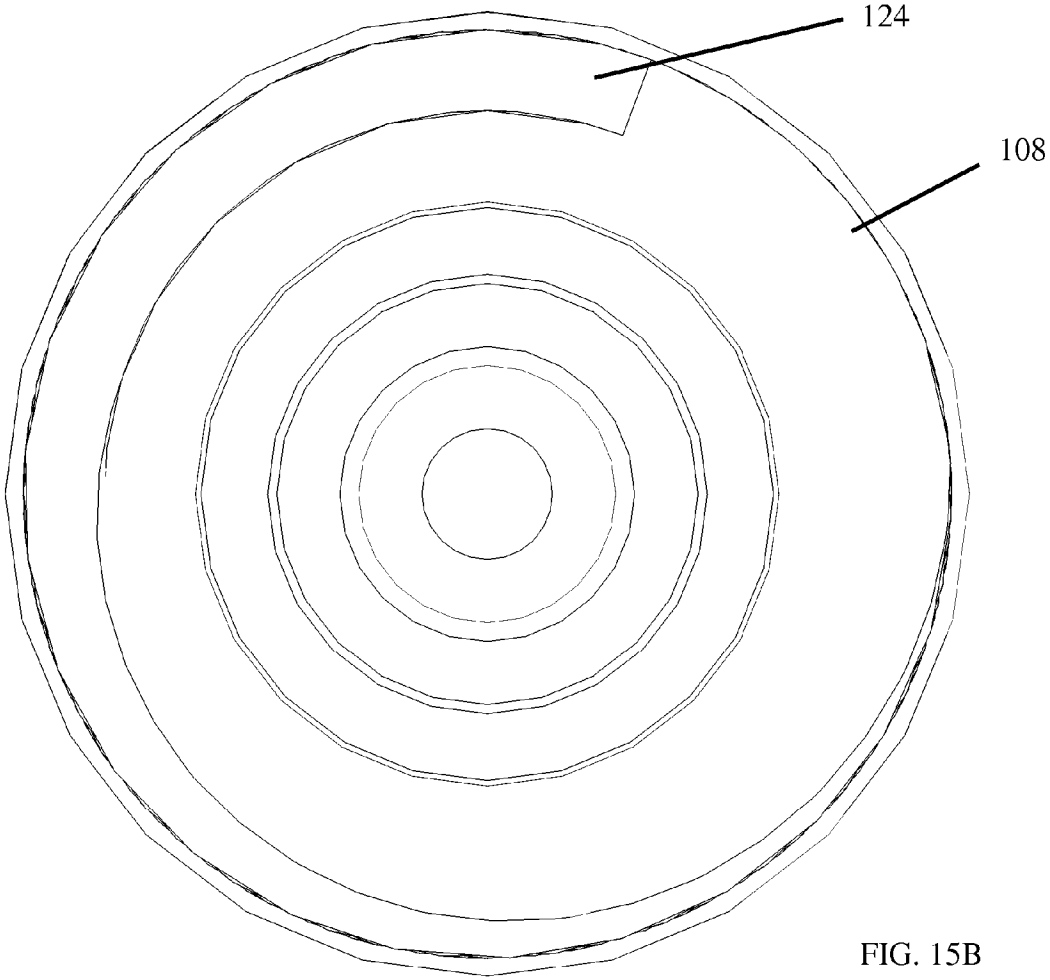
FIG. 15B is a top view of one embodiment of the present invention.

FIGS. 15A and 15B show the threaded head 124 of inner body 108. The threaded head 124 is threaded to enable attachment of adjustment head 102 to threaded head 124.

Figure 16A:
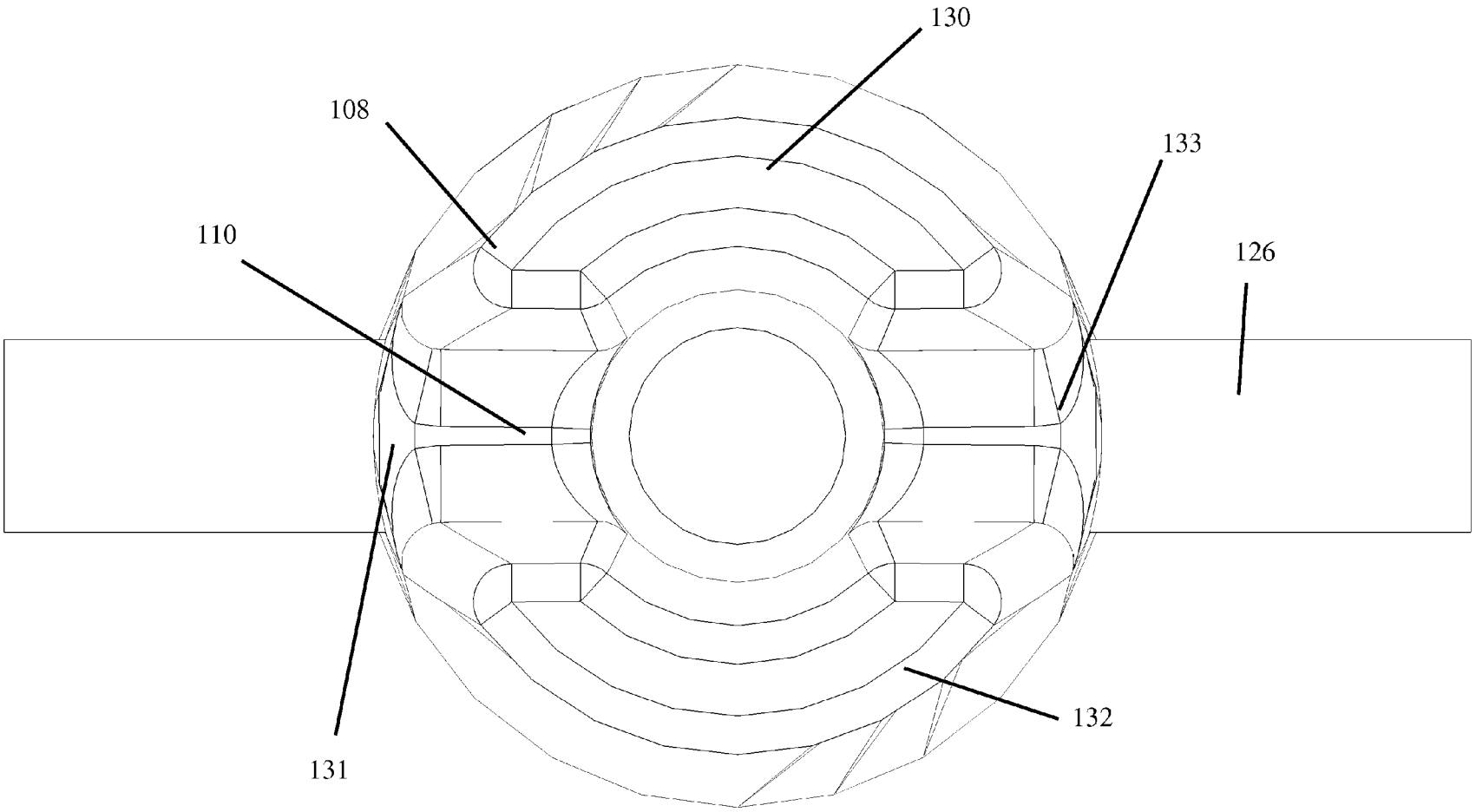
FIG. 16A is a bottom view showing one embodiment of the present invention.
Figure 16B:
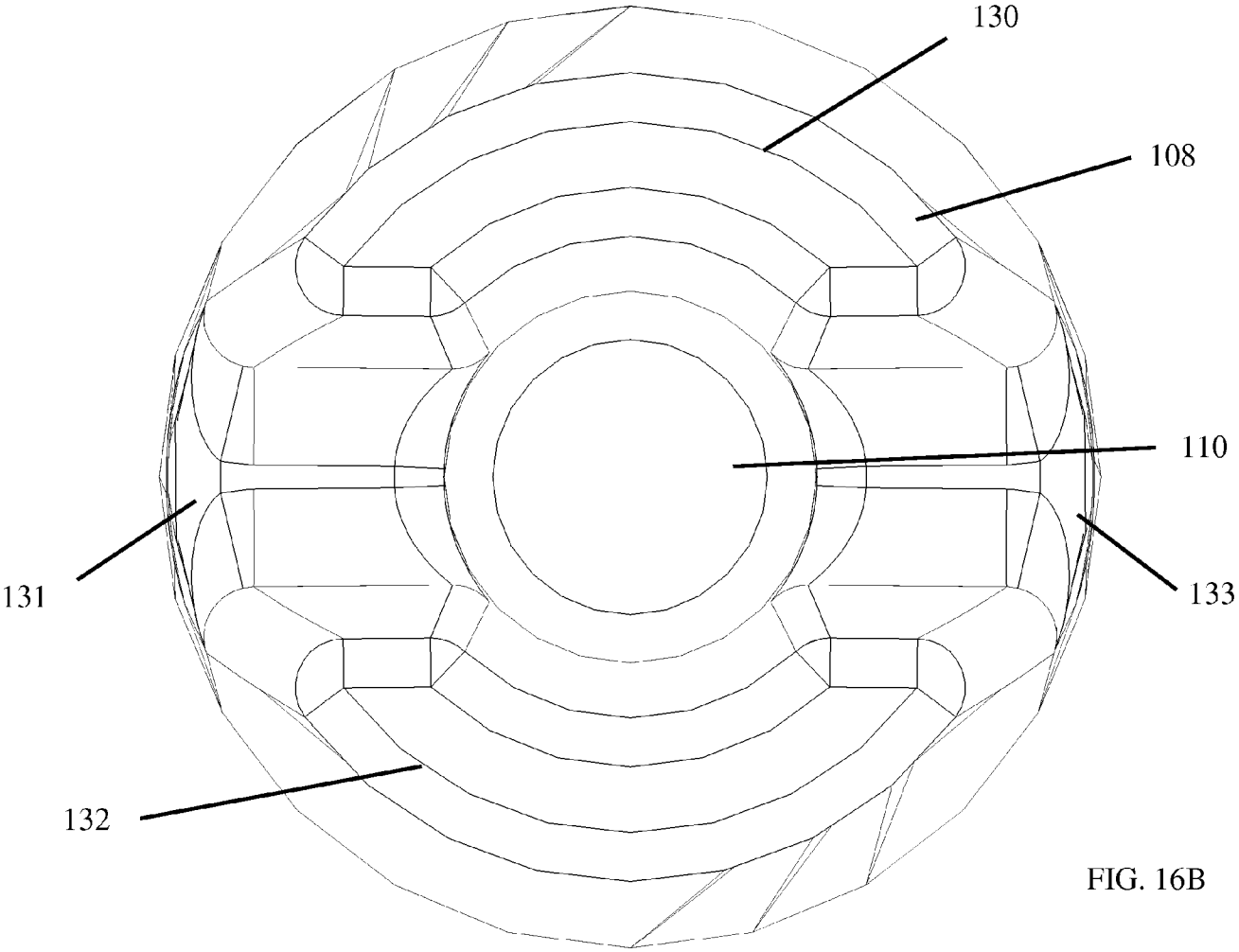
FIG. 16B is a bottom view showing one embodiment of the present invention.
Figure 17:
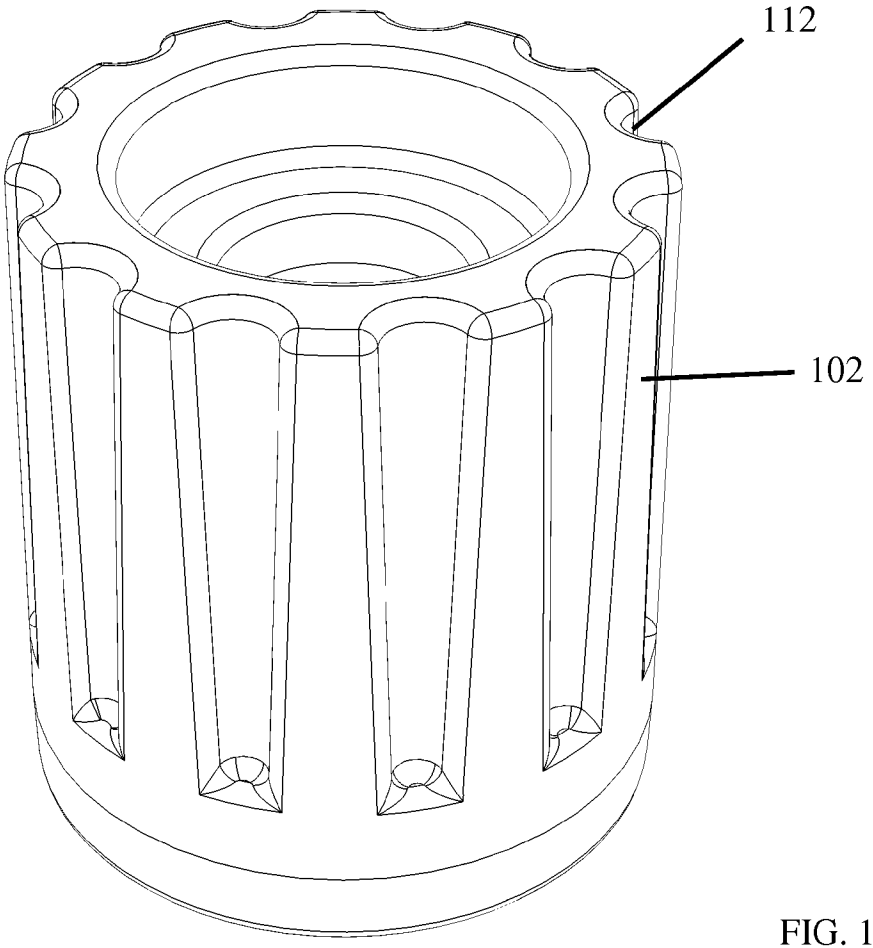
FIG. 17 is a perspective view showing an adjustment head of one embodiment of the present invention.
Figure 18:
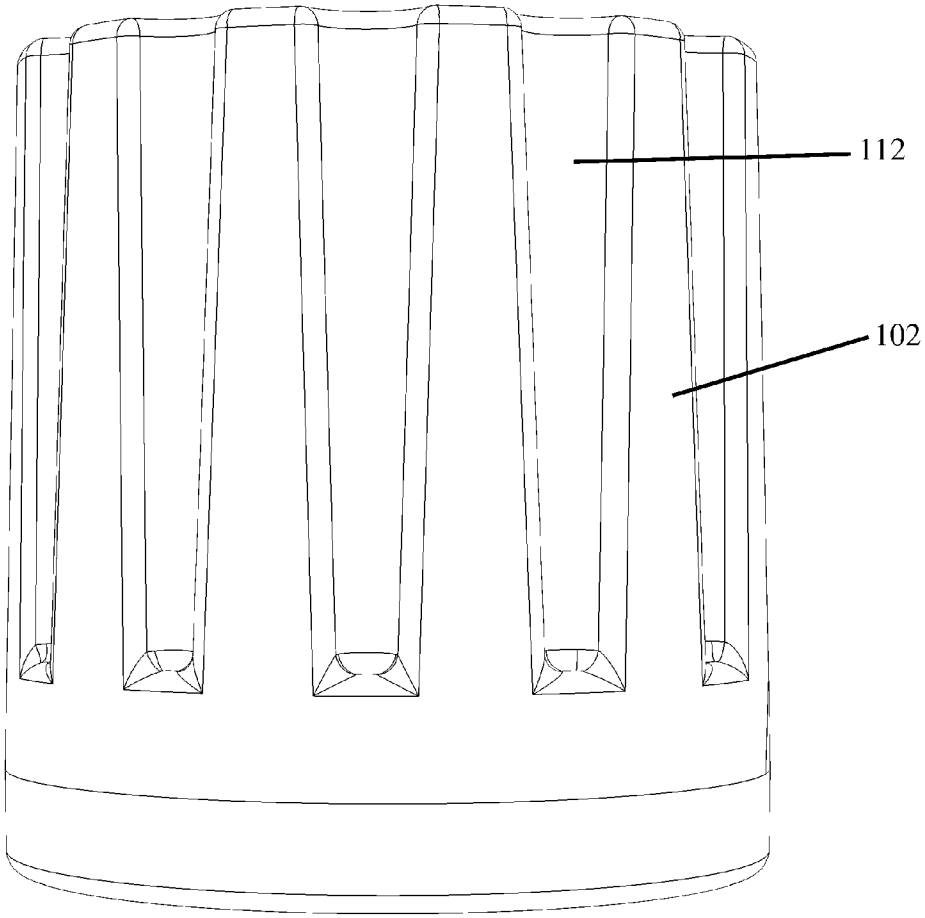
FIG. 18 is a front view thereof, the right side view being a mirror image of the front view; the rear view being a mirror image of the front view; the left side view being a mirror image of the right side view.
Figure 19:
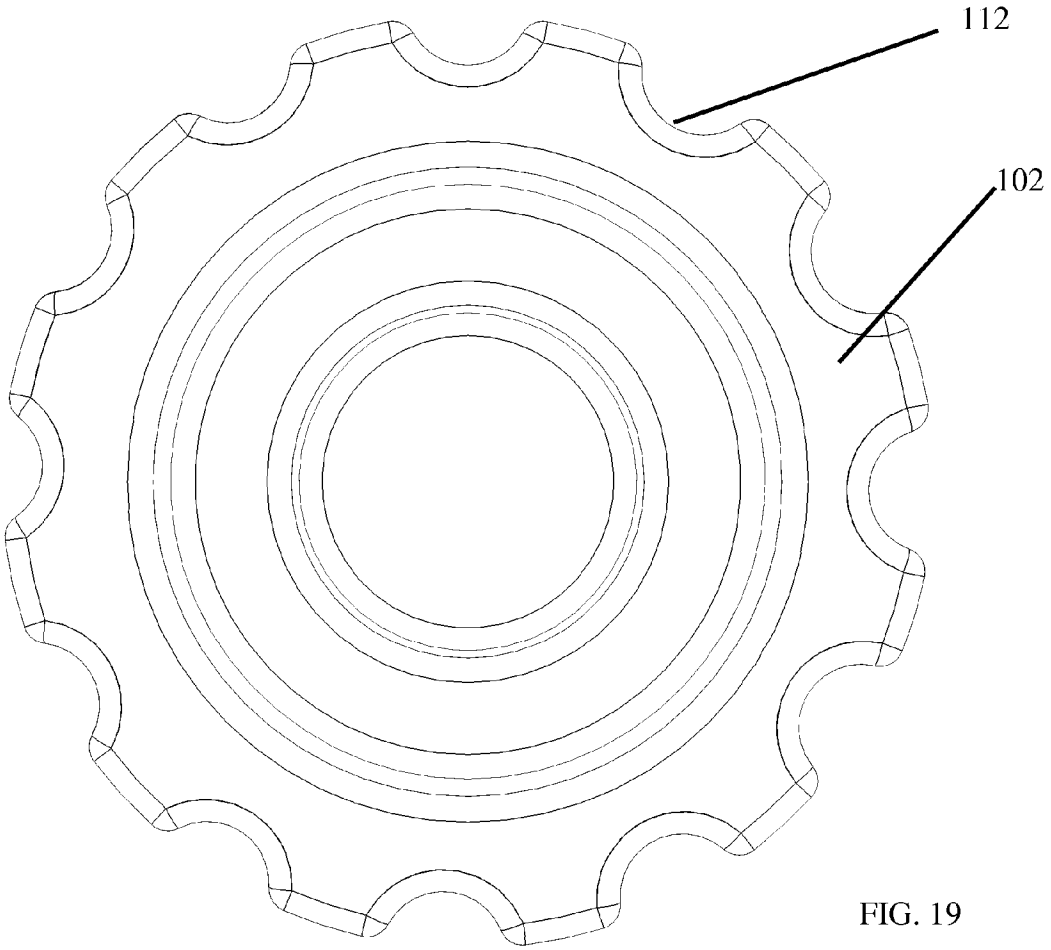
FIG. 19 is a top view thereof.
Figure 20:
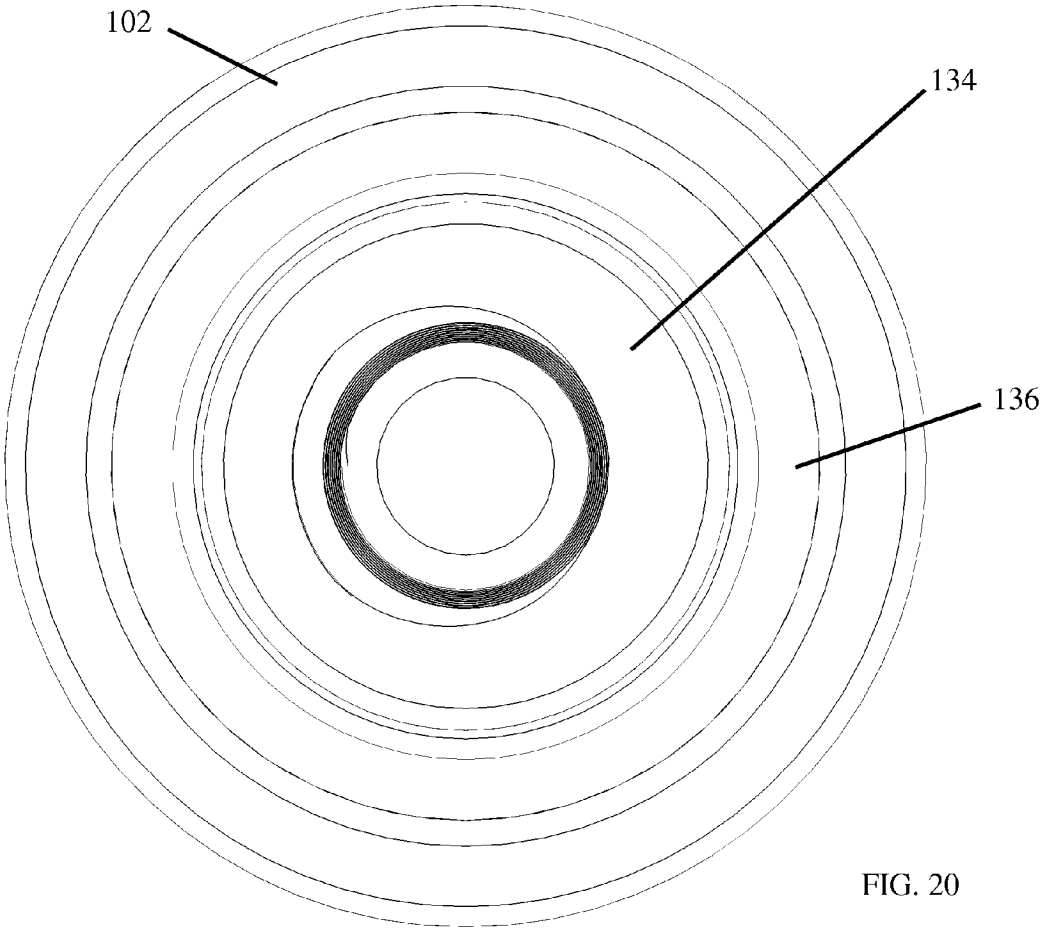
FIG. 20 is a bottom view thereof.

FIGS. 16A and 16B show bottoms views of different embodiments of inner body 108. Inner fingers 130, 132 create insertion aperture 110 and openings 131, 133 for insertion of at least a portion of the article of clothing as discussed above.

Figure 21:
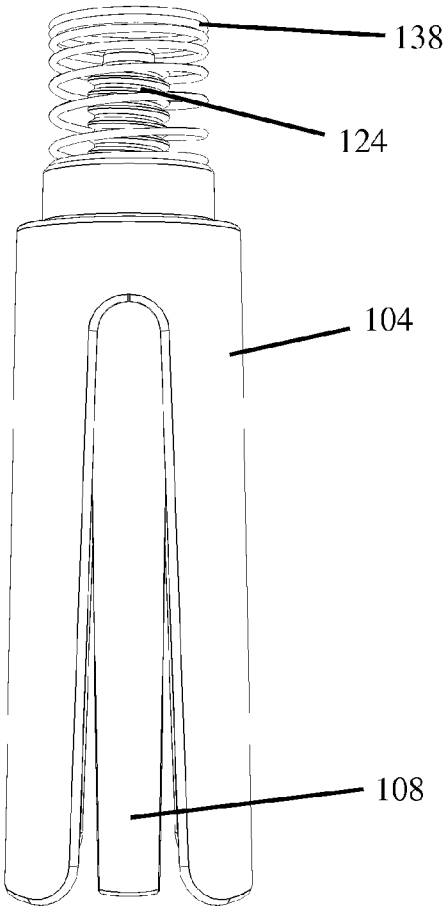
FIG. 21 is a front view of one embodiment of the present invention with the adjustment head removed.

FIGS. 17-20 show the adjustment head 102 of one embodiment of the present invention. As discussed above, the adjustment head 102 attaches to threaded head 124 of inner body 108. Spring aperture 120 of adjustment head 102 fits onto neck 114 of outer body 104. A biasing element, such as spring 138, also fits into spring aperture 120 of adjustment head 102. Spring 138 is placed onto neck 114 and into spring aperture 120 as shown in FIGS. 6 and 21. The attachment head 102 secured to threaded head 124 of inner body 108 maintains the spring 138 between adjustment head 102 and outer body 104. Spring 138 biases adjustment head 102 away from outer body 104. The biasing of adjustment head 102 secured to inner body 104 draws the locking finger 126 into locking teeth 122 to limit rotation of the inner body 108 and adjustment head 102.

The dimensions of the adjustment device may vary upon the user's preferences. In one embodiment, the outer body 104 may be 1 and ¾ inches to 2 and ½ inches, such as 2 and ⅛ inches with a diameter of ¼ inch to an inch, such as a diameter of ⅝ inch. The outer body 104 has locking teeth 122 molded inside as shown in FIGS. 5, 6, 11, and 11B. The openings 117, 119 in the outer body 104 have a length of one inch to two inches in length such as 1 and ⅝ inches long. The openings 117, 119 have a width of 1/16 inch to ¾ inch, such as ⅛ inch wide.

The side wall of outer body 104 has a thickness which could be 1/32 inch to ¼ inch, such as a thickness of 1/16 inch. The shoulder 140 of outer body 104 has a thickness from 1/16 inch thick to ½ inch thick such as ⅛ inch thick. The locking teeth 122 of one embodiment are angled to engage the locking finger 126 when the adjustment head 102 and inner body 108 are turned clockwise. In another embodiment, the locking teeth are angled to engage the locking finger when the adjustment head 102 and inner body 108 are turned counterclockwise. The shoulder 140 is located from ⅛ inch to ½ inch from the top of the outer body 104 such as a ¼ inch from the top of the outer body 104. The installation aperture 142 of one embodiment is centrally located within outer body 104 to accommodate the inner body 108. The installation aperture 142 may have a diameter of ⅛ inch to ½ inch such as ¼ inch diameter. All the edges of one embodiment of the outer body 104 will be smoothly rounded on the outside of the outer body 104 to keep from snagging or cutting skin or fabric. In one embodiment, the outer body 104 provides a neck 114 with a diameter of ¼ inch to an inch, such as ⅜ inch or 7/16 inch wherein the neck 114 is centrally located in the outer body 104.

The inner body 108 has a length of 2 and ¼ inches to 3 and ½ inches such as 2 and 7/16 inches long with a diameter of 1/16 inch to ½ inch, such as ¼ inch diameter. The openings 131, 133 in the inner body 108 will be one inch long to two inches long, such as 1 and ½ inches long. The bottom of the openings 131, 133 is 1/16 inch to ¼ inch wide, such as ⅛ inch wide. The openings 131, 133 taper towards the top of the openings 131, 133. In one embodiment the top of openings 131, 133 taper to 1/32 inch to ¼ inch, such as 3/32 inch at the top. The top ⅛ inch to ½ inch, such as the top ¼ inch of the inner body 108, serves as threaded head 124. The locking finger 126 is located from ¼ inch to one inch, such as ⅝ inch, from the top of the inner body 108. The locking fingers 126 will have a diameter of 1/32 inch to ¼ inch, such as 1/16 inch in diameter. Each locking finger 126 will have a length of 1/32 inch to ¼ inch, such as 3/32 inches in length. The locking fingers 126 should be rounded to avoid catching on fabric. The inner body 108 of one embodiment is hollow with walls having a thickness of 1/10 of an inch to ¼ inch thick, such as ⅙ inch thick.

One embodiment of the adjustment head 102 is ¼ inch to one inch long, such as 9/16 inches long. The diameter of the adjustment head 102 can be sized to fit snugly around the outer body 104 but be able to rotate. In one embodiment, the adjustment head 102 has a diameter of ¼ inch to ⅘ inch, such as ½ inch or ⅝ inch. The spring aperture of adjustment head 102 is sized to fit onto neck 114. The spring aperture 136 has a diameter of ¼ inch to an inch, such as ⅜ inch or 7/16 inch wherein the spring aperture 136 is centrally located in the adjustment head 102.

The exterior of the adjustment head 102 will be knurled or have shallow grooves every 1/16 inch to ¼ inch, such as ⅛ inch, to provide grips 112. The top of the adjustment head 102 of one embodiment is closed. The bottom of adjustment head 102 provides an opening to accommodate the inner body and spring. The walls of adjustment head 102 will have a thickness of 1/32 inch to ¼ inch, such as a thickness of 1/16 inch. The bottom ⅛ inch to ½ inch, such as the bottom ¼ inch, of the adjustment head 102 will be threaded to receive the inner body 108.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A device for adjusting an article of clothing by inserting at least a portion of the article of clothing into the device and winding at least a portion of the article of clothing into the device, the device comprising:

an outer body having an insertion aperture located at a bottom of the outer body;

an inner body having an insertion aperture located at a bottom of the inner body, the inner body rotatably secured to the outer body, the inner body secured at least partially within the outer body, wherein the insertion aperture of the inner body is located on the same side of the device as the insertion aperture of the outer body when the inner body is secured with the outer body;

a locking finger extending from the inner body;

at least one locking tooth of the outer body, wherein the locking tooth limits movement of the locking finger; and a biasing element that biases the locking finger towards the locking tooth to limit movement of the locking finger.

2. A device for adjusting an article of clothing by inserting at least a portion of the article of clothing into the device and winding at least a portion of the article of clothing into the device, the device comprising:

an outer body having an insertion aperture located at a bottom of the outer body;

an inner body having an insertion aperture located at a bottom of the inner body, the inner body rotatably secured to the outer body, the inner body secured at least partially within the outer body, wherein the insertion aperture of the inner body is located on the same side of the device as the insertion aperture of the outer body when the inner body is secured with the outer body;

an installation aperture located within the outer body, wherein the inner body at least partially passes through the installation aperture;

an adjustment head attachable to the inner body, wherein the adjustment head is sized not to pass through the installation aperture;

the installation aperture separating the outer body into a first side and a second side;

the adjustment head attachable to the inner body on the first side of the outer body;

a locking finger extending from the inner body, wherein the locking finger is sized not to pass through the installation aperture, the locking finger located on the second side of the outer body when the adjustment head is secured to the inner body;

the insertion aperture of the inner body and the insertion aperture of the outer body aligned located on the second side of the outer body when the adjustment head is secured to the inner body;

a biasing element located on the first side of the outer body, the biasing element biasing the adjustment head away from the outer body.

3. The device of claim 2 further comprising:

at least one locking tooth located on the second side of the outer body;

the biasing element biasing the locking finger towards the locking tooth to limit movement of the locking finger.

4. The device of claim 2 further wherein the biasing element is located between the outer body and the adjustment head.

5. A device for adjusting an article of clothing by inserting at least a portion of the article of clothing into the device and winding at least a portion of the article of clothing into the device, the device comprising:

an outer body having an insertion aperture located at a bottom of the outer body;

an inner body having an insertion aperture located at a bottom of the inner body, the inner body rotatably secured to the outer body, the inner body secured at least partially within the outer body, wherein the insertion aperture of the inner body is located on the same side of the device as the insertion aperture of the outer body when the inner body is secured with the outer body;

a side wall of the outer body located on the exterior of the outer body;

a shoulder of the outer body located interior of the side wall, wherein the shoulder narrows the insertion aperture of the outer body;

an installation aperture located within the outer body at the shoulder, wherein the inner body at least partially passes through the installation aperture;

an adjustment head attachable to the inner body, wherein the adjustment head is sized not to pass through the installation aperture.

6. The device of claim 5 further comprising:

the installation aperture separating the outer body into a first side and a second side;

the adjustment head attachable to the inner body on the first side of the outer body;

a locking finger extending from the inner body, wherein the locking finger is sized not to pass through the installation aperture, the locking finger located on the second side of the outer body when the adjustment head is secured to the inner body;

the insertion aperture of the inner body and the insertion aperture of the outer body located on the second side of the outer body when the adjustment head is secured to the inner body.

7. The device of claim 6 further comprising:

a biasing element located on the first side of the outer body, the biasing element biasing the adjustment head away from the outer body.

8. The device of claim 7 further comprising:

at least one locking tooth of the outer body, wherein the locking tooth limits movement of the locking finger;

the biasing element biasing the locking finger towards the locking tooth to limit movement of the locking finger.

9. The device of claim 7 further wherein the biasing element is located between the outer body and the adjustment head.

10. A device for adjusting an article of clothing by inserting at least a portion of the article of clothing into the device and winding at least a portion of the article of clothing into the device, the device comprising:

an outer body having a side wall located on the exterior of the outer body;

an inner body having a side wall located on the exterior of the inner body, the inner body rotatably secured to the outer body, the inner body secured at least partially within the outer body;

an installation aperture of the outer body located interior of the side wall of the outer body, wherein the installation aperture narrows the interior of the outer body, the installation aperture enabling the inner body to at least partially pass through the installation aperture, the installation aperture separating the outer body into a first side and a second side;

a first finger of the outer body;

a second finger of the outer body;

a first opening of the outer body, the first opening located between the first finger of the outer body and the second finger of the outer body, the first opening extending from the end of the side wall of the second side of the outer body towards the first side of the outer body;

a second opening of the outer body, the second opening located between the first finger of the outer body and the second finger of the outer body, the second opening extending from the end of the side wall of the second side of the outer body towards the first side of the outer body;

a first finger of the inner body;

a second finger of the inner body;

a first opening of the inner body, the first opening located between the first finger of the inner body and the second finger of the inner body, the first opening extending from the end of the side wall of the second side of the inner body towards the first side of the inner body;

a second opening of the inner body, the second opening located between the first finger of the inner body and the second finger of the inner body, the second opening extending from the end of the side wall of the second side of the inner body towards the first side of the inner body;

the inner body attachable to the outer body such that first opening and second opening of the inner body align with the second side of the outer body.

11. The device of claim 10 further comprising:

an adjustment head attachable to the inner body, wherein the adjustment head is sized not to pass through the installation aperture, the adjustment head configured to rotate with the inner body, wherein the adjustment head is attachable to the inner body on the first side of the outer body;

a locking finger extending from the inner body, wherein the locking finger is sized not to pass through the installation aperture, the locking finger located on the second side of the outer body when the adjustment head is secured to the inner body.

12. The device of claim 11 further comprising:

at least one locking tooth of the outer body, wherein the locking tooth limits movement of the locking finger;

a biasing element located on the first side of the outer body, the biasing element biasing the adjustment head away from the outer body, the biasing element biasing the locking finger towards the locking tooth to limit movement of the locking finger.

* * * * *